US009010705B2

(12) United States Patent
Dastrup

(10) Patent No.: US 9,010,705 B2
(45) Date of Patent: Apr. 21, 2015

(54) GOLF CLUB TOWEL ASSEMBLY

(76) Inventor: David Dastrup, Escondido, CA (US)

( * ) Notice: Subject to any disclaimer, the term of this patent is extended or adjusted under 35 U.S.C. 154(b) by 0 days.

(21) Appl. No.: 13/442,619

(22) Filed: Apr. 9, 2012

(65) Prior Publication Data

US 2012/0256067 A1 Oct. 11, 2012

Related U.S. Application Data

(60) Provisional application No. 61/473,275, filed on Apr. 8, 2011.

(51) Int. Cl.
*A63B 57/00* (2006.01)
*A63B 55/00* (2006.01)

(52) U.S. Cl.
CPC ..... *A63B 57/0087* (2013.01); *A63B 55/008* (2013.01)

(58) Field of Classification Search
USPC ..... 24/300; 248/225.21, 690, 691, 692, 248/693, 74.5, 96, 100, 101, 211, 213, 215, 248/227.1, 234, 290.1, 294.1, 301, 303, 248/304, 339, 340
See application file for complete search history.

(56) References Cited

U.S. PATENT DOCUMENTS

| | | | | | |
|---|---|---|---|---|---|
| 548,027 | A | * | 10/1895 | Bernhard | 379/448 |
| 2,121,561 | A | * | 6/1938 | English | 150/106 |
| 2,704,071 | A | * | 3/1955 | Becker | 604/115 |
| 3,100,324 | A | * | 8/1963 | Tutino et al. | 24/346 |
| 4,707,906 | A | * | 11/1987 | Posey | 29/453 |
| 4,831,692 | A | * | 5/1989 | Chuan | 24/300 |
| 4,993,126 | A | | 2/1991 | Collins | |
| 5,099,897 | A | * | 3/1992 | Curtin | 150/159 |
| 5,168,605 | A | * | 12/1992 | Bartlett | 24/519 |
| 5,177,881 | A | * | 1/1993 | Moore | 34/239 |
| 5,332,090 | A | | 7/1994 | Tucker | |
| 5,344,109 | A | * | 9/1994 | Hokoana, Jr. | 248/100 |
| 5,590,773 | A | * | 1/1997 | Robinett | 206/315.1 |
| 5,671,515 | A | | 9/1997 | Evans | |
| 5,784,762 | A | * | 7/1998 | Huntting | 24/129 R |
| 5,950,981 | A | * | 9/1999 | Judy | 248/693 |
| 6,760,956 | B1 | | 7/2004 | Lee et al. | |
| 6,776,317 | B1 | * | 8/2004 | Parker | 224/251 |
| 2007/0220717 | A1 | * | 9/2007 | Brinson | 24/298 |
| 2007/0226934 | A1 | * | 10/2007 | Bohannon et al. | 15/209.1 |
| 2009/0151105 | A1 | * | 6/2009 | Bohannon et al. | 15/210.1 |

* cited by examiner

*Primary Examiner* — Kimberly Wood
(74) *Attorney, Agent, or Firm* — The Law Office of Jane K. Babin, Professional Corporation; Jane K. Babin

(57) ABSTRACT

An assembly is provided for carrying a golf towel, the assembly comprising a hook, a hanger and a connector connecting the hook and the hanger. The assembly can be removably attached to the shaft of a golf club. The methods of making and using the assembly are also disclosed.

3 Claims, 9 Drawing Sheets

GOLF CLUB TOWEL ASSEMBLY

RELATED APPLICATIONS

This application claims the benefit of priority under 35 USC §119 of U.S. Provisional Application Ser. No. 61/473,275 filed Apr. 8, 2011, the entire disclosure of which is incorporated herein by reference.

FIELD OF THE INVENTION

This invention relates generally to the field of accessories for golfing. More specifically, the invention pertains to golf towels and to assemblies for carrying such towels on a golf course.

BACKGROUND

Golf is a popular activity and many devices and items have been developed to assist golfers in improving their game and to make the activity more comfortable and pleasurable. Among these are devices useful for carrying golf towels.

When on a golf course, golf players often carry towels with them to be used for various purposes such as for cleaning dirt, grass residue and other materials on the golf ball, club faces and/or the player's hands. Existing devices that are used for carrying towels include carabiner-type assemblies and caddies. Typically, one or more golf towels are attached to his belt or to a carabiner (i.e., a D-shaped ring equipped with a spring catch on one side) on his golf bag. This occasionally may be distracting during the round of play and presents a nuisance to the player.

Some other existing devices for carrying towels provide for clipping a caddy on a golf shaft. The towel then can be removed by pulling on the caddy or the towel. The clip thus allows for unintended disconnections of the towel. The possibility of such accidental disconnection is very undesirable.

Accordingly, better devices and assemblies for carrying golf towels are desired. The present application provides some of such improved devices and assemblies.

SUMMARY OF THE INVENTION

According to one aspect of the invention, there is provided an assembly for carrying a golf towel, the assembly includes a hook, a hanger and a flexible connector for removably connecting the hook to the hanger, wherein the hook is configured to allow a detachable attachment of the assembly to the shaft of the golf club.

According to another aspect of the invention, there is provided a towel to be used with the assembly for carrying a golf towel, the towel being a multi-layered towel composition comprising a microfiber wet side towel, a microfiber dry side towel and a waterproof barrier layer.

According to yet another aspect of the invention, a method for placing a golf towel on the shaft of a golf club, the towel having a hanging element, the method including making an assembly for carrying a golf towel, running the assembly through the hanging element of the golf towel, and hooking the assembly to the shaft of the golf club.

DETAILED DESCRIPTION

It is to be understood that both the foregoing general description and the following detailed description are exemplary and explanatory only and are not restrictive of the invention claimed. As used herein, the use of the singular includes the plural unless specifically stated otherwise.

As used herein, "or" means "and/or" unless stated otherwise. Furthermore, use of the term "including" as well as other forms, such as "includes," and "included," is not limiting and its meaning is the same as that of "comprising."

The section headings used herein are for organizational purposes only and are not to be construed as limiting the subject matter described.

"About" as used herein means that a number referred to as "about" comprises the recited number plus or minus 1-10% of that recited number. For example, "about" 100" (i.e., inches) can mean 95-105" or as few as 99-101" depending on the situation. Whenever it appears herein, a numerical range such as "1 to 20" refers to each integer or fractional unit thereof in the given range; for example and without limitation to a specific range content, "1 to 20"" means that a specified measurement can be 1", 2", 3", etc., up to and including 20", while1.1 to 20.0" means that a specified measurement can be 1.1", 1.2", 1.3", etc., up to and including 20.0".

EMBODIMENTS OF THE INVENTION

According to embodiments of the present invention, various devices are provided for carrying a towel while playing golf as well as methods for using such devices. The devices of the present invention may be generally described with the reference to FIGS. 1-7 showing, but not limited to, certain exemplary embodiments of the invention.

Figure 1A:
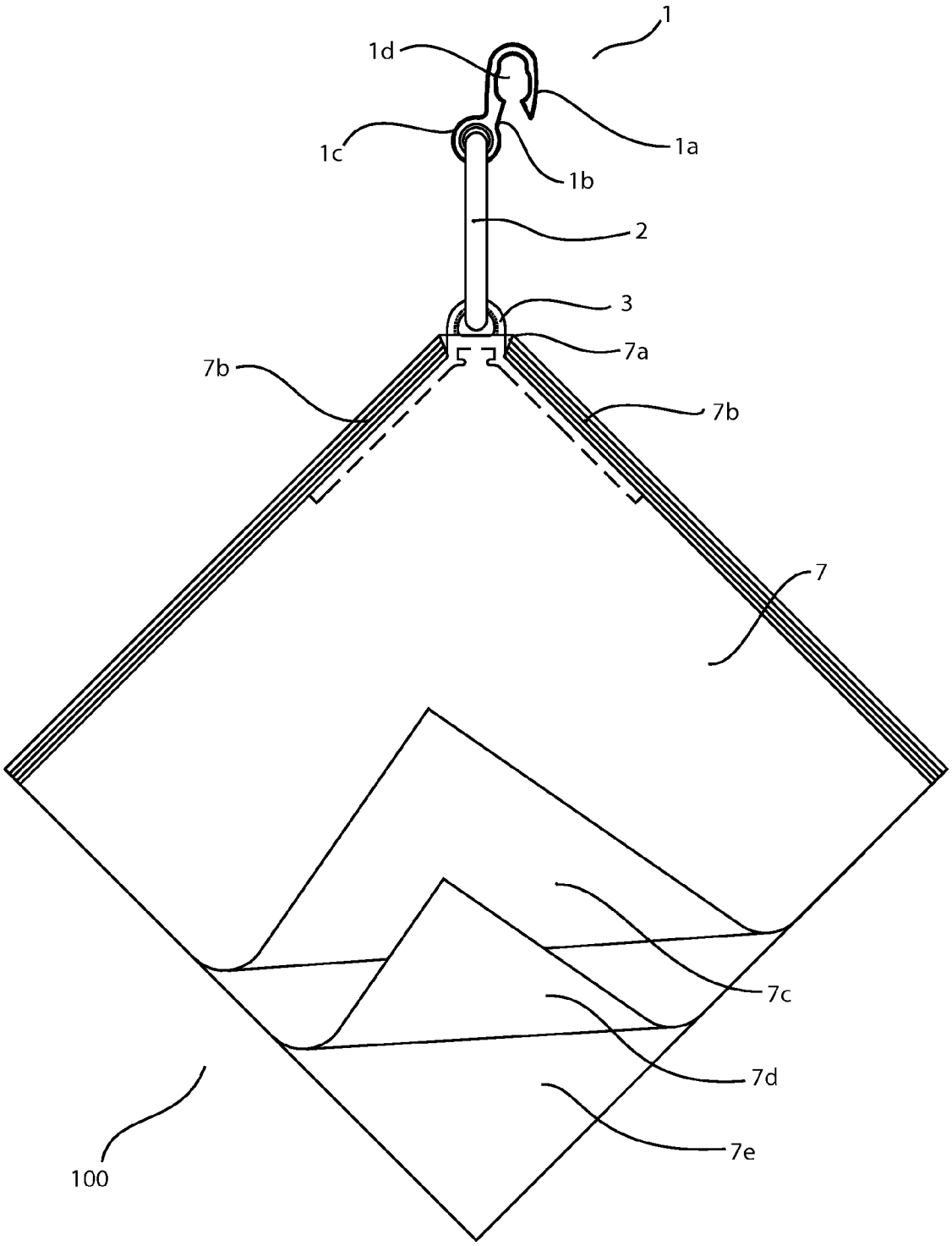
FIG. 1A depicts schematically an exemplary assembly according to an embodiment of the invention and a towel that is used with the assembly.
Figure 4:
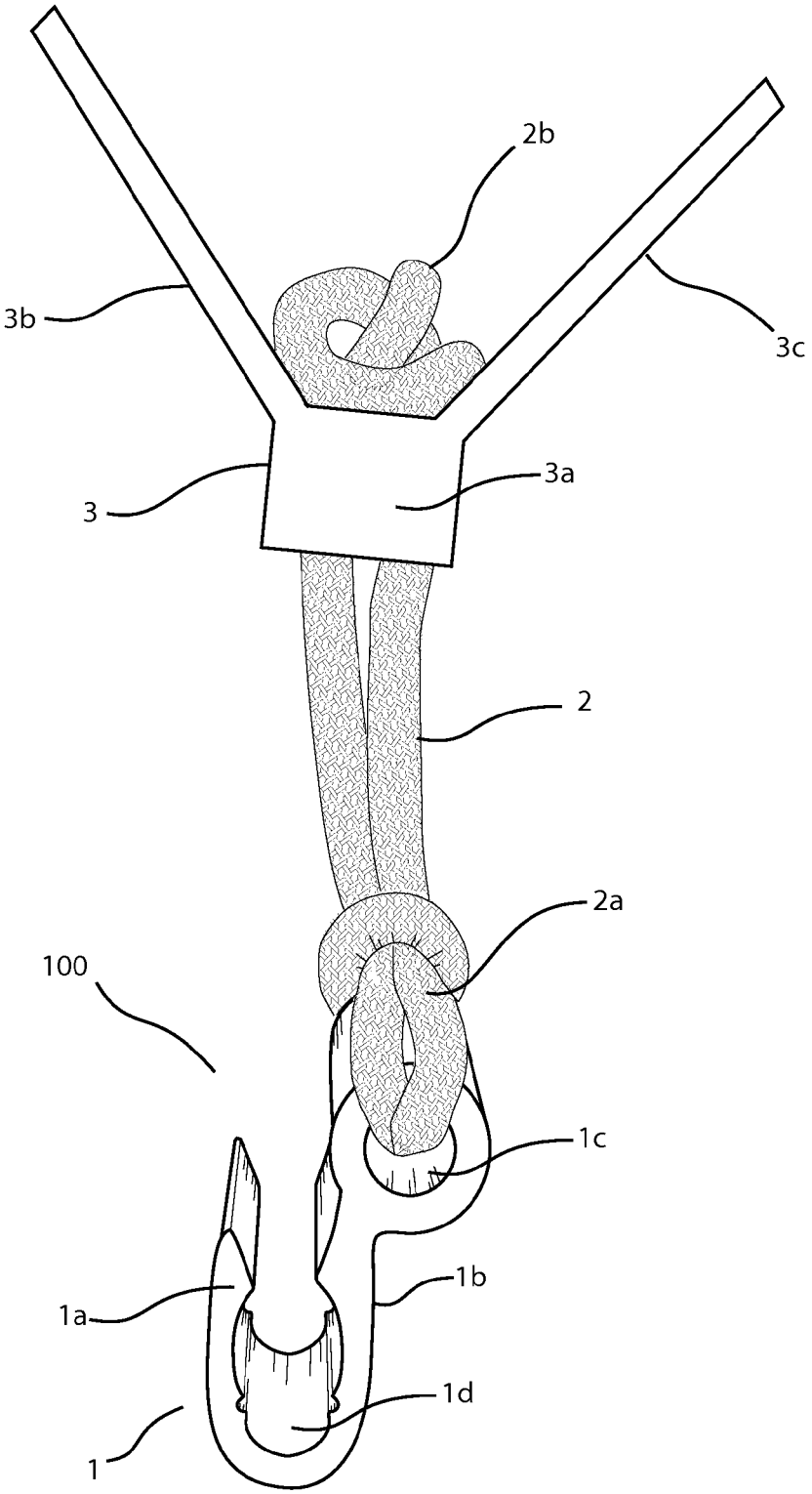
FIG. 4 depicts schematically an exemplary assembly according to an embodiment of the invention.
Figure 5A:
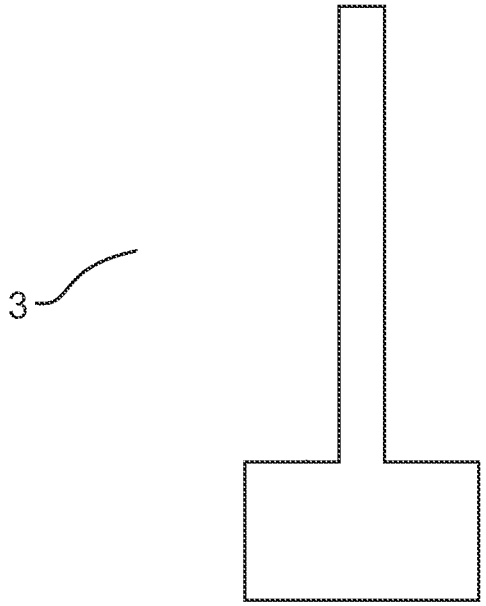
FIGS. 5A and 5B depict schematically side and top views, respectively, of a hanger that is used in an exemplary assembly according to an embodiment of the invention.
Figure 5B:
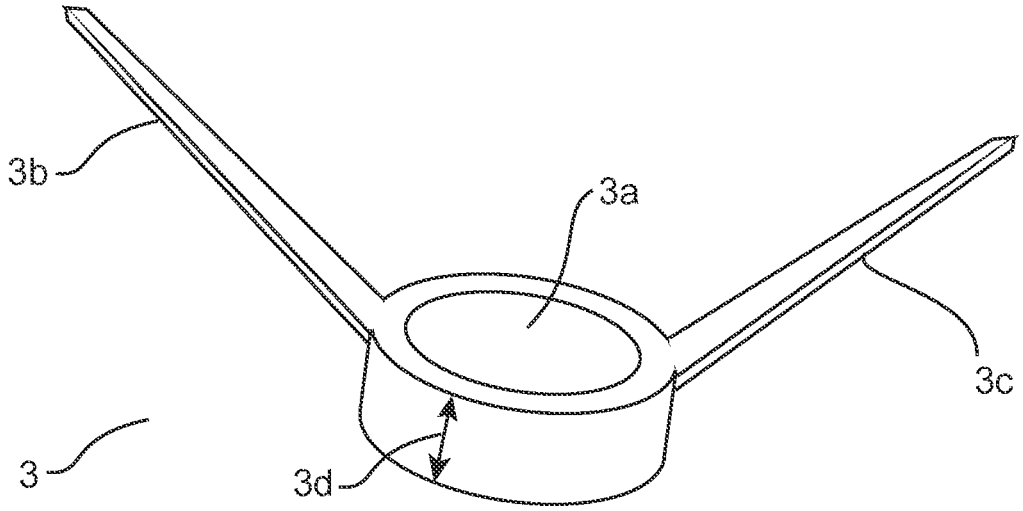
Figure 6:
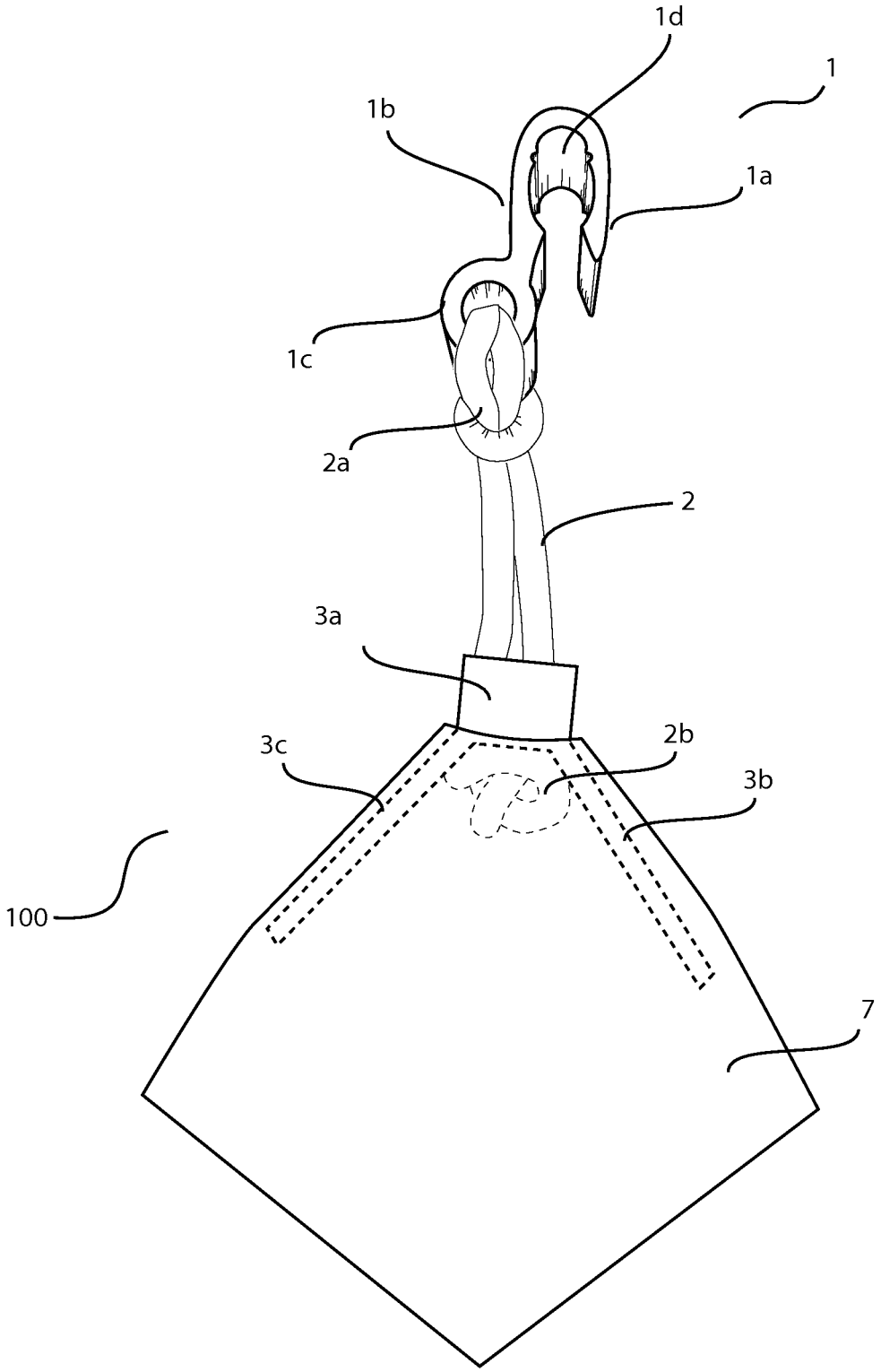
FIG. 6 depicts schematically an exemplary assembly according to an embodiment of the invention and a towel that is used with the assembly.

More specifically, FIGS. 1A, 4 and 6 depict schematically an assembly 100 for carrying a towel while playing golf according to one embodiment of the present invention. The assembly comprises a hook 1 having a hooking section 1*a*, an eyelet section 1*c* and a connecting section 1*b* that connects the hooking section 1*a* to the eyelet section 1*c*. The hooking section 1*a* taken together with the connecting section 1*b* define the cavity 1*d* that is used for attaching the hook to the shaft of the golf club (not shown) as described in more detail below.

The hook 1 shown in more detail on FIGS. 1B, 2, 3A and 3B can be fabricated of any suitable material. Examples of suitable materials include, but are not limited to, glass-filled nylon or another sturdy plastic material, or a metal, such as stainless steel, aluminum or bronze. Another suitable material may be selected, if desirable, by those having ordinary skill in the art. The hook 1 can have the thickness 1*e* (FIG. 2) between about ⅛" and about ⅝", for example, about ⅜".

The hook 1 can be manufactured by any suitable method to be selected by those having ordinary skill in the art. One example of the manufacturing technique that can be used is injection molding plastic. Alternative fabrication methods include machining, water jet cutting and laser cutting. The hook 1 so fabricated includes the cavity 1*d* comprising two distinct curved portions, i.e., a narrower curved portion and a wider curved portion, the two curved portions being adjacent to, and integrated with, each other, as illustrated by FIGS. 3A and 3B.

The greatest dimension if of the narrower curved portion can be between about 0.25" and about 0.35", such as between about 0.30" and about 0.31", for example, about 0.3077". The greatest dimension 1*g* of the wider curved portion can be between about 0.30" and about 0.50", such as between about 0.35" and about 0.40", for example, about 0.3750". The total length 1*h* of the cavity 1*d* can be between about 0.4" and about 0.7", such as between about 0.5" and about 0.6", for example, about 0.5481" and the width 1*i* at the opening point of the cavity 1*d* can be between about 0.15" and about 0.25", such as between about 0.16" and about 0.20", for example, about 0.189".

Figure 3A:
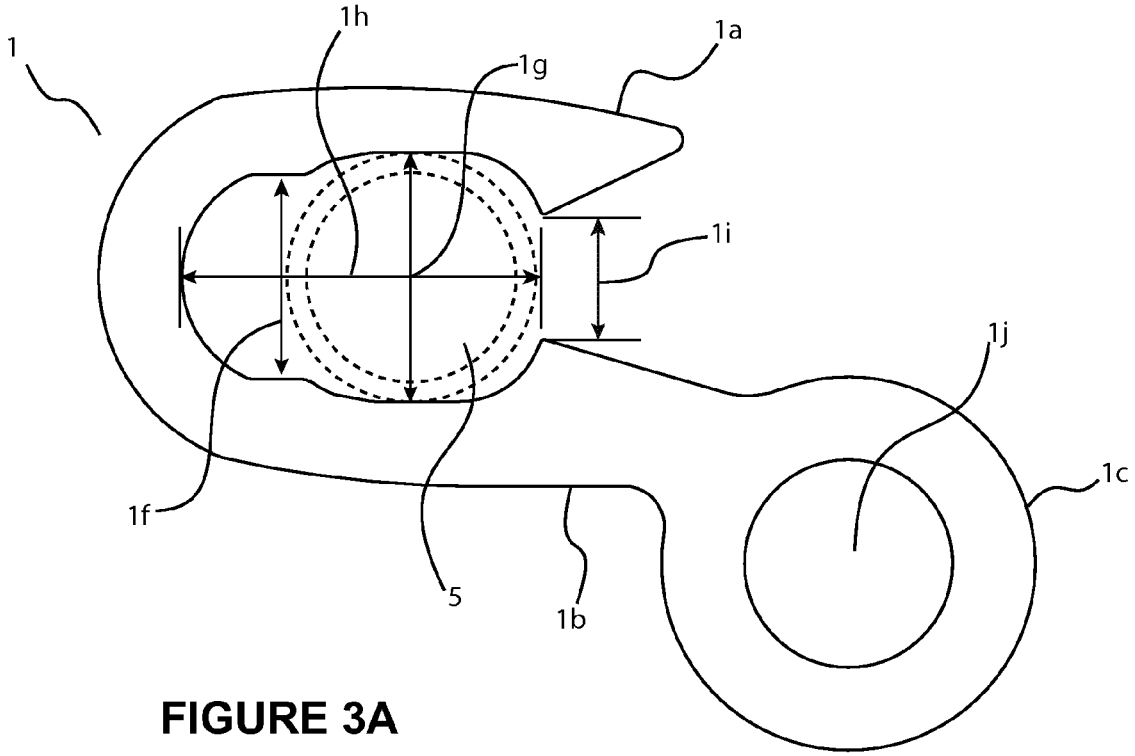
FIGS. 3A and 3B provide further details pertaining to the used in some embodiments of the invention.
Figure 3B:
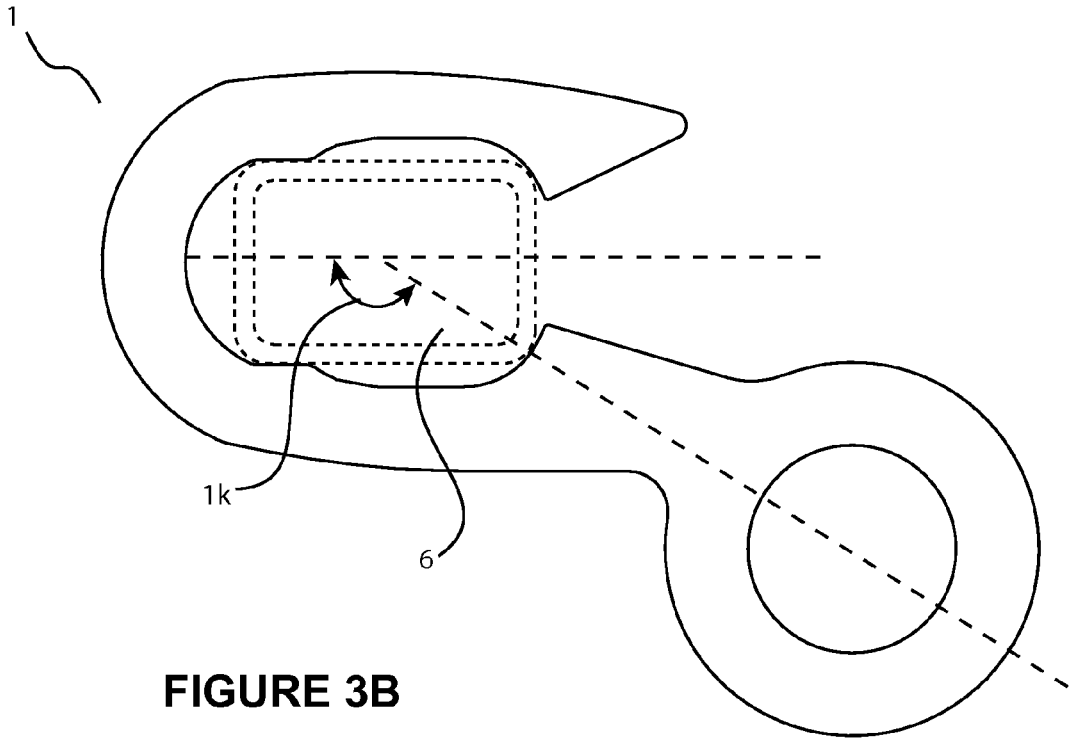

As can be seen from FIG. 3A, the eyelet section 1*c* defines the inner cavity 1*j* that is essentially circular and can have the diameter between about 0.125" and about 0.50" such as between about 0.30" and about 0.32", for example, about 0.3125". As can be also seen from FIGS. 3A and 3B, the axis of the hooking section 1*a* is positioned at an angle to the axis of the eyelet section 1*c*. This angle, 1*k* (FIG. 3B) can be between about 20 degrees and about 140 degrees, for example, between about 30 degrees and 45 degrees.

Figure 1B:
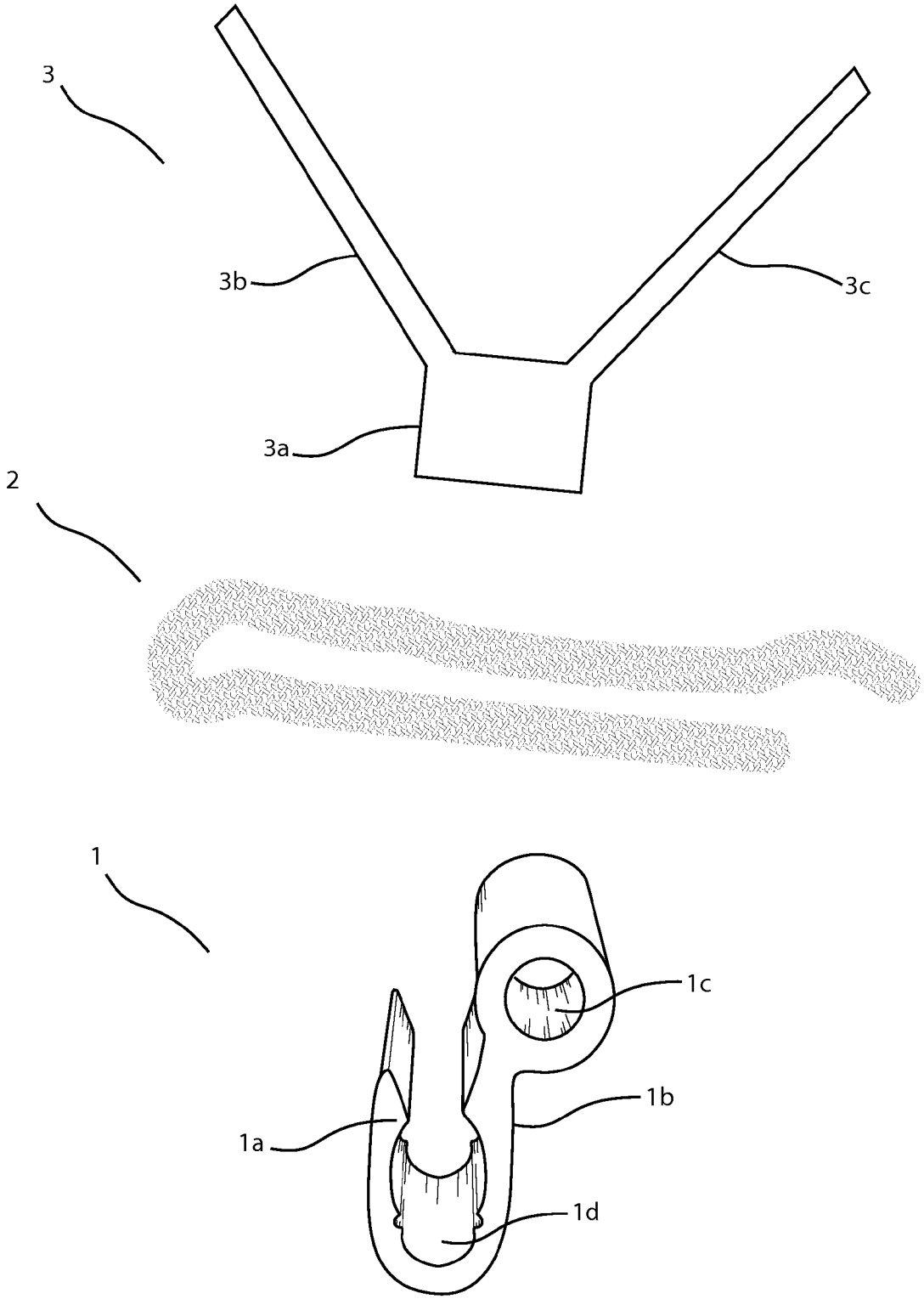
FIG. 1B depicts schematically parts of an exemplary assembly according to an embodiment of the invention.
Figure 2:
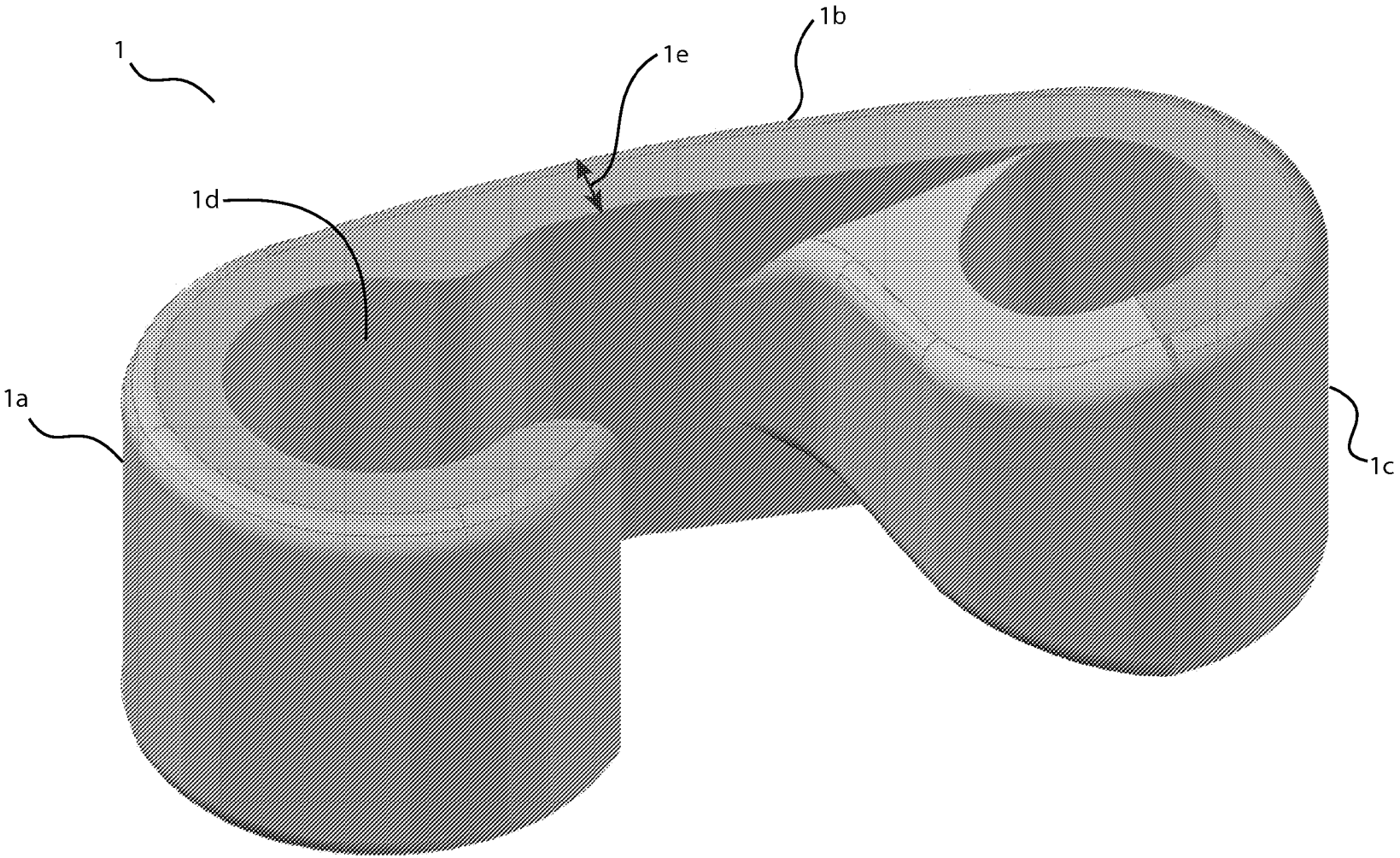
FIG. 2 depicts schematically a hook that is used in an exemplary assembly according to an embodiment of the invention.

The assembly 100 further includes a lanyard 2 having two ends (also shown separately on FIG. 1B). One end of the lanyard 2 is roved through the circular opening in the eyelet section 1*c* of the hook 1 and the other through the opening (which can optionally be essentially circular) 3*a* of the hanger 3 as shown on FIGS. 1A and 4. Other means for attaching the lanyard will be apparent to those skilled in the art. The lanyard 2 is made of a suitable flexible material such as a rope, a cord, a string or a chain, for example, of a nylon rope.

The length of the lanyard 2 may be between about 1" and about 12", for example, between about 3" and about 10". The lanyard 2 may be of any thickness so long as it is possible to draw the lanyard 2 through the circular opening in the eyelet section 1*c* of the hook 1 and through the opening 3*a* of the hanger 3. Typically, the diameter of the lanyard 2 is between about 0.125" and about 0.375", such as about 0.25".

Each end of the lanyard 2 is securely but removably fastened, respectively, to the eyelet section 1*c* of the hook 1 and to the hanger 3, as shown on FIGS. 1A and 4. In the embodiments of FIGS. 4 and 6, the lanyard 2 is attached by making knots 2*a* and/or 2*b*, but alternatively those reasonably skilled in the art may select another feasible means of fastening, if desired, such as using loops (not shown). Thus, the lanyard 2 connects the hook 1 and the hanger 3.

The hanger 3 comprises the upper portion that contains the opening 3*a* mentioned above and two arms 3*b* and 3*c* integrated with the upper portion (see FIGS. 1B, 4, 5A, 5B and 6). Each of the arms 3*b* and 3*c* can have the same or a different length within the range of between about 2" and about 5", for example, between about 1" and about 4", and the ends of each of the arms 3*b* and 3*c* can be optionally rounded to avoid having sharp edges.

The hanger 3 can be fabricated of any suitable material. Examples of suitable materials include, but are not limited to, glass-filled nylon, another sturdy plastic material, or a metal, such as stainless steel, aluminum or bronze. Another suitable material may be selected, if desirable, by those having ordinary skill in the art. The same or different materials can be used for fabricating the hook 1 and the hanger 3. The hanger 3 can have the thickness 3*d* (FIG. 5B) between about ¼" and about 1", for example, about ½".

A towel to be used with the above described assembly would have a hanging element such as circular element 7*a* (FIG. 1A) made in the body of the towel, a loop, an opening or a hole in the towel. for hanging sewn to the towel. To accommodate a towel, the user will first make the assembly 100 shown on FIG. 4. The hook 1 is then inserted through this hanging element. The hook 1 is then drawn through the hanging element followed by roving the lanyard 2 through the hanging element until the towel reaches the hanger 3. The process of setting the towel on the assembly 100 ends when the towel rests upon the arms 3*b* and 3*c* of the hanger 3 as shown on FIGS. 1A and 6.

Once the towel has been installed, the user would hook the assembly 100 to a golf club. The club can be a putter or any other club. Clubs with a hosel which has either a round shape 5 (illustrated on FIG. 3A) or a rectangular shape 6 (FIG. 3B) can be accommodated. The assembly 100 thus hooks to the shaft via the hooking section 1*a* of the hook 1 and is securely held in place by the force of friction. Yet at the same time, the above-described features of the hook 1 allow the user to easily slide the assembly 100 up and down the shaft of the golf club, if the user so desires. The fact that the assembly 100 is attached to the shaft of the golf club instead of clips on the shaft provides a secure connection; as a result, the assembly cannot be accidentally pulled off like the clip.

Figure 8A:
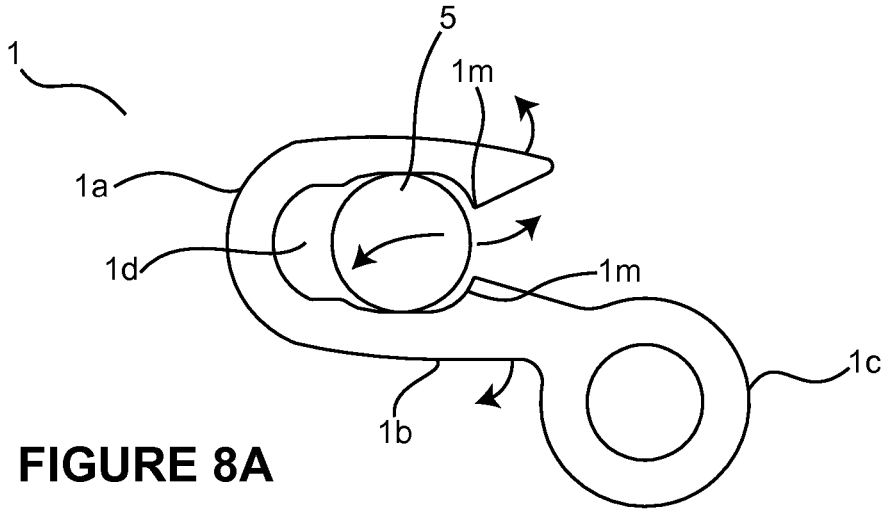
FIGS. 8A, 8B and 8C depict schematically an exemplary assembly according to one embodiment of the invention and schematic demonstration of how the assembly can be removed from the shaft of a golf club.
Figure 8B:
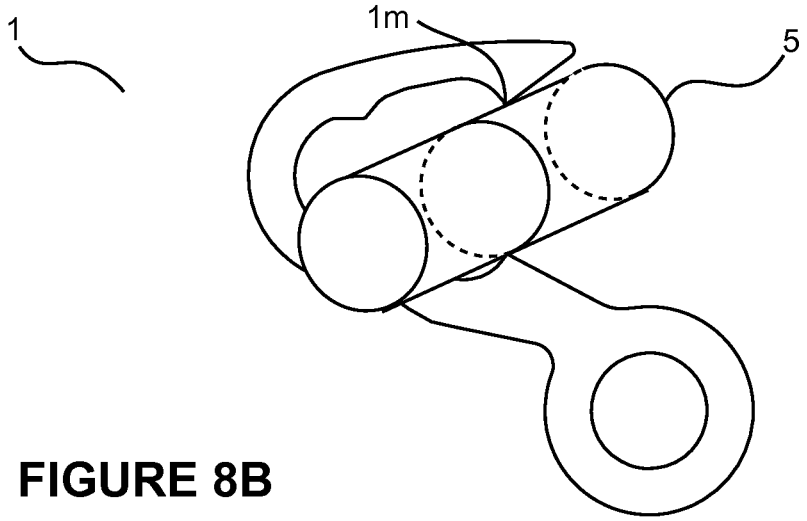
Figure 8C:
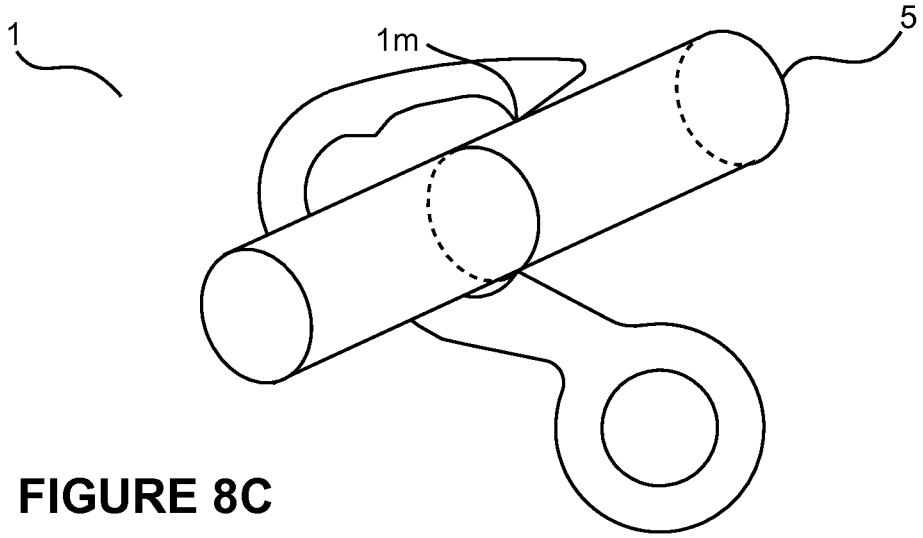

Some embodiments of the present invention also allow the user to have both the secure connection when the assembly 100 is mounted on the shaft of the club and easy removal. As shown on FIGS. 8A-8C, according to some embodiments the hook 1 includes some protruding elements or "barbs" 1*m* that crate the narrow opening and prevent the hook 1 from unhooking on its own. To remove the hook 1 from the shaft the user needs to rotate the hook 1 as if trying to turn the "V" shape from perpendicular to parallel the shaft (FIG. 8A). This uses the shaft to force the "V" shape open enough so the barbs 1*m* release from the shaft. The bevels help align the shaft in the middle of the "V" shape as the user rotates the hook 1 (FIG. 8B). The closed end 1*d* acts as a pivot and touches the shaft during the process of rotating forcing barbs 1*m* against the shaft and opening the barbs 1*m* (FIG. 8C). Accordingly, the hook 1 does not come off without being rotated off. The barbs 1*m* hold the hook 1 on the shaft and do not spread easy without the rotation maneuver described above.

When at the green the user would take the club out of the golf bag and the assembly 100 and the towel would come with the club. This means the user does not need to be concerned about remembering a towel to clean the equipment. While making a golf stroke, the user can simply twist the assembly 100 off the shaft of the club and hook it onto a pocket or belt loop so there is no need for the user to carry the assembly 100 and the towel. Once finished with that club the user would hook the assembly 100 and the towel back on the club, replace the club into the bag and continue on till the towel is needed again. Embodiments of the present invention allow for the towel to be accessible while the club is in the bag because it hangs over the edge of the bag the same as a towel attached to the bag in a regular way would hang.

Various towels are envisioned for the use with the assembly 100 described above. The towels are typically made of a microfiber terry cloth, but if desired those having ordinary skill in the art may choose towels made of another kind of fabric. In some embodiments, the towels can be rectangular or square, such as squares having the sides with the length between about 5" and about 15", such as 10" by 10" squares. The towel can have any desirable thickness, for example, between about ⅛" and about ¼".

Figure 7:
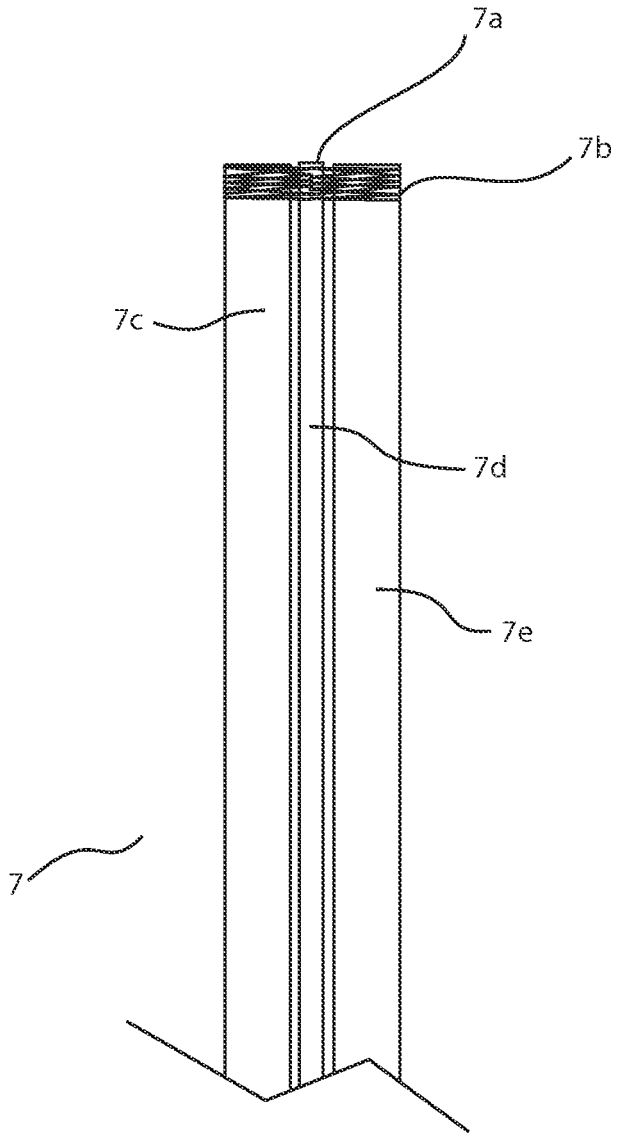
FIG. 7 depicts schematically a towel that can be used with the assembly in some embodiments of the invention.

In some embodiments, multi-layer towels can be used. One such embodiment illustrated on FIGS. 1A and 7 provides for a three-layered towel 7 which can be also seen as a combination of three individual towels. One of these towels, 7*c*, is designated as a microfiber wet side towel. The other towel, 7*e* is designated as a microfiber dry side towel. The two towels 7*c* and 7*e* are separated by a waterproof barrier 7*d*. The waterproof barrier can be fabricated of any suitable material, such as nylon. The three layers are sewn together along the edges 7*b*. As can be seen from FIG. 7, the waterproof barrier 7*d* is even with the towel edge 7*f*, thus ensuring that no water will wick from the wet side 7*c* to the dry side 7*e*.

Although the foregoing invention has been described in some detail by way of illustration and example for purposes of clarity and understanding, it will be apparent to those of ordinary skill in the art in light of the teaching of this invention that certain changes and modifications may be made thereto without departing from the spirit or scope of the appended claims.

What is claimed is:

1. A method for placing a golf towel on the shaft of a golf club, the method comprising:

(a) making an assembly comprising the following steps:

i. providing:

1. a hook comprising a hooking section, an eyelet section, and a connecting section that connects the hooking section to the eyelet section, wherein the hooking section and the connecting section define a first opening therebetween and the eyelet section defines a second opening, wherein the first opening comprises a narrower curved portion having the greatest dimension of between about 0.25" and about 0.35", and a wider curved portion adjacent to, and integrated with, the narrower curved portion, the wider curved portion having the greatest dimension of between about 0.30" and about 0.50";
2. a hanger comprising an upper portion defining an essentially circular third opening, and two arms integrated with the upper portion, wherein the two arms are positioned at an angle to each other to provide the hanger with an inverted V-shape over which the towel can be draped; and;
3. a flexible connector having the first end and the second end for removably connecting the hook to the upper portion of the hanger, wherein the hook is configured to allow a detachable attachment of the assembly to the shaft of the golf club, ii. roving the first end of the flexible connector through the second opening in the eyelet section;

iii. fastening the first end of the flexible connector to the hook;

iv. roving the second end of the flexible connector through the essentially circular third opening in the upper portion of the hanger; and v. fastening the second end of the flexible connector to the hanger;

(b) providing the golf towel having a hanging element;

(c) running the assembly through the hanging element of the golf towel, so as to have the golf towel rest upon the two arms of the hanger; and (d) hooking the assembly to the shaft of the golf club via the hooking section of the hook, to thereby place the golf towel on the shaft of the golf club.

2. A method for removing a golf towel from the shaft of a golf club after the hooking step of claim 1, the method comprising rotating the hook to move the hook from being perpendicular to the shaft to being parallel to the shaft, to thereby unhook the assembly from the shaft.

3. The method of claim 1, wherein the hosel of the golf club is rectangular or round.

* * * * *